United States Patent [19]

Fanti

[11] Patent Number: 4,524,473

[45] Date of Patent: Jun. 25, 1985

[54] FOAM MATERIAL BODY FOR A PAD, PARTICULARLY A MATTRESS

[75] Inventor: Hansruedi Fanti, Flüh, Switzerland

[73] Assignee: Matra AG, Flüh, Switzerland

[21] Appl. No.: 456,759

[22] Filed: Jan. 10, 1983

Related U.S. Application Data

[63] Continuation-in-part of Ser. No. 188,595, Sep. 19, 1980, Pat. No. 4,397,053.

[30] Foreign Application Priority Data

Sep. 20, 1979 [CH] Switzerland ..... 8481/79

[51] Int. Cl.[3] ..... A47C 27/14

[52] U.S. Cl. ..... 5/481; 5/468

[58] Field of Search ..... 5/481, 468, 448, 420; 297/DIG. 1

[56] References Cited

U.S. PATENT DOCUMENTS

| | | | |
|---|---|---|---|
| 2,371,788 | 3/1945 | Weeber | 5/481 |
| 3,028,610 | 4/1962 | Talalay | 5/481 |
| 3,885,257 | 5/1975 | Rogers | 5/481 |
| 4,070,719 | 1/1978 | Morgan | 5/468 |

FOREIGN PATENT DOCUMENTS

| | | | |
|---|---|---|---|
| 407491 | 3/1970 | Australia | 5/481 |
| 561722 | 11/1957 | Belgium | 5/481 |
| 571845 | 1/1976 | Switzerland | 5/481 |

*Primary Examiner*—Alexander Grosz
*Attorney, Agent, or Firm*—Michael J. Striker

[57] ABSTRACT

A foam material body for a bed, particularly a mattress, has a body part with a plurality of channels each having two deep channel portions located at opposite sides of a transverse plane of symmetry of the channel, and two narrow channel portions each extending from a respective one of the deep channel portions of the same channel. Each of the channels may have a maximum cross sectional dimension in direction parallel to supporting surfaces which is greater than a maximum cross sectional dimension of each of the deep channel portions in direction normal to the supporting surfaces. Each of the deep channel portions can increase in direction away from the middle channel portion of each channel, so that web-like sections formed between two channels of each pair extend toward the middle channel portion of the respective channel.

20 Claims, 4 Drawing Figures

FOAM MATERIAL BODY FOR A PAD, PARTICULARLY A MATTRESS

CROSS-REFERENCE TO A RELATED APPLICATION

This application is a continuation-in-part of application Ser. No. 188,595, filed Sept. 19, 1980 now U.S. Pat. No. 4,397,053.

BACKGROUND OF THE INVENTION

The present invention relates to a foam material body for a pad, particularly a mattress.

Prior to a description of the present invention, it is believed to be advisable to define certain terms which will be utilized hereinafter. In the field to which the present invention pertains, the terms "lower mattress" and "upper mattress" are frequently used. In an element of furniture utilized for lying and provided with spring transverse battens (which are called in Switzerland "lattlicouch"), the lower mattress is formed by a batten grate. When the term "mattress" is mentioned in the following description and claims, it is utilized to identify the upper mattress.

It is known to provide foam material bodies for mattresses with throughgoing openings and passages which extend transverse to the direction of elongation of the mattress, so as to influence the deformability and to provide ventilation of the mattress. One such foam material body with several embodiments is disclosed, for example, in U.S. Pat. No. 3,885,257, which also discloses the respective pad. The foam material body is provided at both supporting surfaces with mutually intersecting channels, and the channels are arranged in pairs. In several embodiments the cutouts have a cross section with a thin initial portion which opens at one supporting surface of the body and an enlarged portion connected with the thin portion. The cross section of the enlarged portion is of for example substantially oval or rectangular shape. The dimension of the enlarged portions as measured in direction normal to the supporting surfaces is approximately equal to the dimension of the same measured parallel to the supporting surfaces. In these foam material bodies, mushroom-shaped pins are formed between the intersecting channels, each having a stem and a head. When the foam material body is loaded, for example, by a lying person, the head part extending laterally beyond the stem parts of the pins and not supported are considerably bent relative to the central longitudinal plane of the foam material body. The foam material body therefore has, in the event of provision of the above mentioned head parts, only a small carrying capacity, and the carrying capacity can be considerably different at different locations of the supporting surfaces, which is very undesirable. Since the stems of the pins can easily bend in all directions parallel to the supporting surfaces, the foam material body in the region of its supporting surfaces is also very soft, which is disadvantageous. The strong deformability of the pins, as well as the partially sharp-edged formation of the channels, is unfavorable for the service life of the foam material body. The webs which are formed along the longitudinal plane of symmetry in the center between the supporting surfaces and between two channels of each pair are limited in the known foam material body by concave faces or by mutually parallel flat faces. This formation of the webs contradicts a good deformability of the material body.

SUMMARY OF THE INVENTION

Accordingly, it is an object of the present invention to provide a foam material body for a mattress, which avoids the disadvantages of the prior art.

More particularly, it is an object of the present invention to provide a foam material body for a mattress which, starting from its horizontal position, is highly flexible along a vertical plane extending in its longitudinal direction and is not excessively compressed at individual locations despite loading of its supporting surfaces.

In other words, it is an object of the present invention to provide a foam material body for a mattress which has an increased flexibility compared with known mattresses, and in addition provides for a better adaptability to the contours of the user's body than known mattresses.

In keeping with these objects and with others which will become apparent hereinafter, one feature of the present invention resides, briefly stated, in a foam material body which has a plurality of channels each having two deep channel portions located at opposite sides of the transverse plane of symmetry of each channel and two narrow channel portions each extending from a respective one of the deep channel portions of the same channel.

In accordance with another advantageous feature of the present invention, each of the channels is formed so that its one maximum dimension measured in direction parallel to the supporting surfaces is greater than its another maximum dimension measured in direction normal to the supporting surfaces.

Still another feature of the present invention is that each of the deep channel portions of each of the channels has a depth increasing in direction away from the central channel portion so that each of the web-like sections formed between two channels of each pair extends toward the central channel portion of the respective channel.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
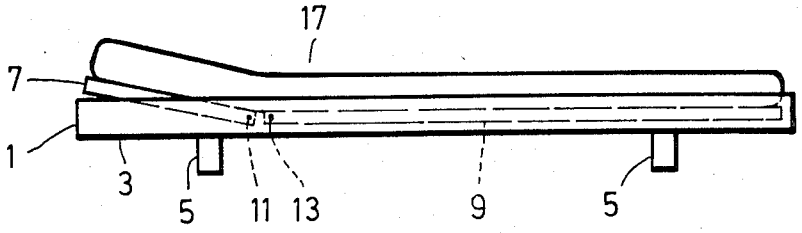
FIG. 1 is a side view of an element of furniture with a mattress formed in accordance with the present invention.

FIG. 1 shows an element of furniture adapted for supporting a person in a lying position. It comprises a support 1, a frame 3 and legs 5. Two batten grates 7 and 9 are supported on the frame 3 pivotally about axes 11 and 13. The axes 11 and 13 are horizontal and extend transverse to the longitudinal direction of the support 1.

Figure 2:
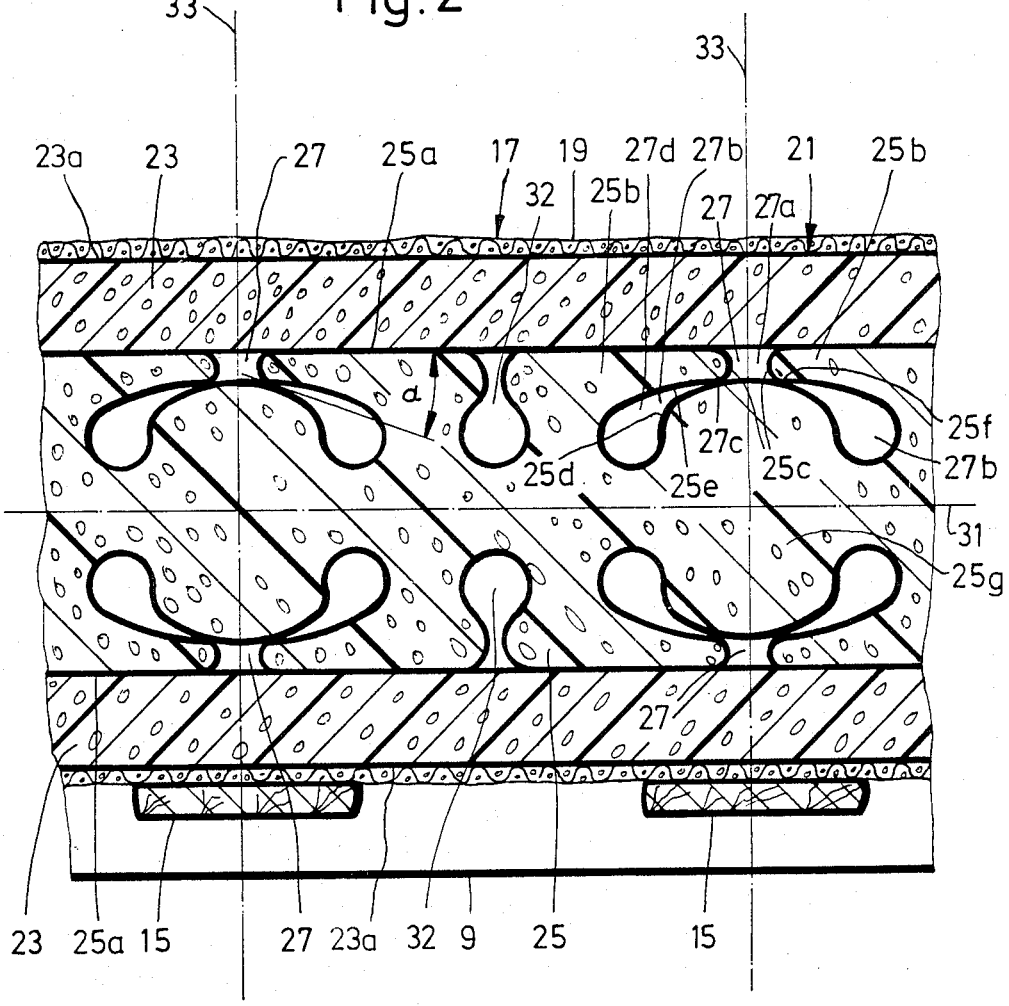
FIG. 2 is an enlarged view showing a section of a part of a batten grate and the inventive mattress supported on the same.

Both batten grates 7 and 9 can be fixed in different tilting positions by not shown adjustable supporting members. Each of the batten grates is provided with several spring transverse battens which extend parallel to one another in direction transverse to the direction of elongation of the support 1 and are spaced from one another by identical distances. Two of these transverse battens of the batten grate 9 are shown in FIG. 2 and identified by reference numeral 15. Both batten grates support a mattress 17.

The construction of the mattress 17 can be clearly appreciated from FIG. 2 and will now be explained in detail. The mattress has a jacket 19 which is constituted substantially of a fabric and embraces a foam material body which is identified in toto by reference numeral 21. The foam material body 21 includes three layers which in normal position are flat and extend in a horizontal direction. More particularly, these layers include two outer layers 23 and a core 25 located therebetween. The core 25 is glued with or welded to the outer layers 23 along its supporting faces.

The core 25 of the foam material body 21 is constituted for example of polyurethane or polyester. The outer layers 23 are preferably constituted of a softer foam material than the core 25, for example of a latex foam material. Both outer layers 23 are generally formed as plates which do not have passages, recesses or the like, with the exception of the pores of the foam material itself. The outer layers 23 have outer surfaces which are identified by reference numeral 23*a* and forming supporting surfaces on the finished foam material body.

The core 25 is also substantially plate-shaped and bounded from above and from below by two supporting surfaces 25*a*. When the foam material body extends horizontally without deformation, the supporting surfaces 25*a* are parallel to one another and flat. A longitudinal central or inner plane 31 which forms in the shown embodiment a plane of symmetry extends between both supporting surfaces 25*a* and also extends in a horizontal plane.

The term "central" plane is used here to define an inner plane which extends substantially midway between the supporting surfaces. It is to be understood that in asymetric bodies the central plane 31 will not be a plane of symmetry.

The core 25 is provided in its supporting faces 25*a* with a plurality of channels 27. The channels 27 are straight and extend parallel to and at equal distances from one another. The channels 27 extend in direction transverse to the direction of elongation of the foam material body over the whole transverse extension of the core. The direction of elongation of the mattress for a double layer corresponds to the general direction in which the user's body extends in lying position. The channels 27 extending from the upper and lower supporting surfaces 25*a* form a plurality of pairs which in undeformed condition are symmetrical relative to the central plane 31. The whole foam material body 21 is symmetrical relative to the central plane 31.

Moreover, each channel 27 in undeformed condition is symmetrical relative to its plane of symmetry 33 which extends normal to the central plane 31. The planes of symmetry 33 extend in direction of elongation of the channels 27.

Each channel 27 has an initial or middle channel portion 27*a* which is open at a respective one of the supporting surfaces 25*a*. Each middle channel portion 27*a* has an end facing toward the interior of the core 25 and branches at this end into two deeper channel portions 27*b*. Each deeper channel portion 27*b* is connected with the middle channel portion 27*a* by a narrow channel portion 27*c*. Each deeper channel portion 27*b* enlarges in direction away from the middle channel portion 27*a* so as to form a pear-like portion 27*d*.

A pair of lip-shaped core sections 25*b* are formed between each channel portion 27*b* and the respective supporting surface 25*a* at which the latter is open. The lip-shaped core sections 25*b* have ends 25*c* which face toward one another and bound a free intermediate space formed by the middle channel portions 27*a*. The distance between the free ends of each pair of lip-shaped core sections is equal approximately to 3 mm and preferably is selected between 5 mm and 15 mm.

The deeper channel portions 27*b* are bounded from inside, that is in the region closer to the central plane 31, by a bounding face 25*d* of the core. The bounding faces 25*d* are curved and inclined from the middle channel portions 27*a* to the deeper channel portions 27*b* in direction toward the central plane 31. Thereby the enlarged pear-like portions 27*d* are located close to the central plane 31. The lip-shaped core sections 25*b* are bounded from inside by bounding faces 25*e* which are curved from the free ends 25*c* of the lip-shaped core sections to the roots of the latter, so that the bounding faces 25*e* approach the central plane 31. The thickness of the lip-shaped core sections measured in direction normal to the supporting surfaces 25*a* thereby gradually increases toward the roots of the lip-shaped core sections.

The channels 27 are, for instance, produced by a cutting tool as cut-outs in the supporting surfaces 25*a* of the core. In the region of the narrow channel portions 27*c*, the width of the recesses is as small as possible. In the region of the narrower channel portions 27*c*, the distance between the lip-shaped core sections 25*b* and the bounding face 25*d* is relatively small and equal to, for example, substantially between 1 and 2 mm. When the mattress is loaded by a person in the region of the lip-shaped core sections 25*b*, the latter lie near their free ends on a part 25*f* of the bounding face 25*d*. The above mentioned parts 25*f* on which the lip-shaped core sections 25*b* lie in loaded condition is inclined relative to the supporting surface 25*a* at an angle which is identified by the letter $\alpha$. The angle $\alpha$ which somewhat varies along the parts 25*f* does not exceed 45°, and preferably is equal to 30°.

Each channel 27 extending from a respective one of the supporting surfaces 25*a* has the deepest point which is spaced from this supporting surface in direction normal to the latter by a distance smaller than half the height of the core 25, and therefore also smaller than half the height of the body 21, measured in the same direction. Preferably, this distance is equal to substantially between 30% and 40% of the height of the core. Thus, the recesses are completely on the one side or on the other side of the central plane 31 and do not reach the latter.

Four deeper channel portions 27*b* of two channels 27 which are symmetrical relative to the central plane 31, together limit a web 25*g* which is constituted of foam material of the core 25. In the region of the central plane 21 the web 25*g* is connected with the material of the remaining portion of the core 25. The bounding faces 25*d*, which bound the web 25*g*, extend approximately as circular arcs toward the axis, at least in the region which is close to the plane of symmetry 33. The center of this circular arcs is formed by intersection of the central plane 31 with the planes of symmetry 33.

As can be seen from FIG. 2, an additional channel 32 is provided in between two neighboring channels 27 in each supporting surface 25*a* of the foam material body 21. The channels 32 extend parallel to the channels 27 and have a pear-shaped or drop-shaped cross section. Each channel 32 has a mouth portion which somewhat enlarges outwardly. Such channels are known for the foam material bodies of mattresses, wherein they provide for increased flexibility. In the mattress in accordance with the present invention, wherein the flexibility is guaranteeds by the channels 27, the additional channels 32 are provided only in the region which starts at a distance of approximately 30 cm from one side and ends at a distance of approximately 60 cm from the same side of the foam material body. The user's shoulders are generally located in this region, and this region is softer and better deformable than the remaining part of the foam material body. Thereby, it is guaranteed that correct depression for the shoulders is formed when the user lies on the mattress in side position.

It should be mentioned that the channels 27 and 32 in the finished foam material body 21 with its core 25 and both outer layers 23 are closed by these layers. Therefore, in the finished foam material body these channels are not merely cut-outs but instead are formed as channels which are closed at all their sides. Correspondingly, the supporting surfaces 25*a* of the core form in the finished foam material body 21 inner surfaces of the latter which limit the core containing the channels. The supporting surfaces of the foam material body as a whole are thereby formed by the supporting surfaces 23*a* of the outer layers 23. Furthermore, the portions formed between the supporting surfaces 23*a* of the outer layers 23 and the channels 27 no longer form lips in direct sense, but instead form continuous portions of the foam material body. In other words, during observation of the finished foam material body, the lip-shaped core sections are available only when the outer layers are imagined to be absent.

As can be seen from FIG. 2, the neighboring transverse battens 15 are spaced from one another by a distance which is equal to the distance between neighboring channels 27. Thus the mattress 17 can be so arranged on the batten frames 7 and 9 that each pair of channels 27 are located above one transverse batten 15.

During utilization of the mattress 17, it can be bent or angled from its horizontal position along a vertical plane extending in its longitudinal direction, for example by inclination of the batten grate 7, as shown in FIG. 1. The neutral fiber pertaining to this bending is located then at least near the central plane 31. In the bending positions, the lip-shaped core sections 25*b* of each channel 27 provided in the upper supporting surfaces of the core 25 displace toward one another, whereas the lip-shaped core sections in the lower supporting surface of the core displace away from one another.

The web 25*g* provided with arcuate upper and lower bounding faces 25*d* forms a kind of hinge about which the lip-shaped core sections 25*b* slide. The outer layers 23 overlap the middle portions 27*a*. However, as the outer layers are relatively thin and preferably composed of a softer and more easily stretched foam material than the core, they are compressed at the upper side of the foam material body 21 and stretch at the lower side of the same in bent condition.

The foam material body 21 has very good flexibility in a plane which is normal to the longitudinal direction of the channels 27. Since the lip-shaped core sections 25*b* near their free ends 25*c* lie on the parts 25*f* of the bounding faces 25*d*, the resistance to compression of the foam material body 21 is reduced only insignificantly, despite the pressure applied in the region of the channels 27 normal to the supporting surfaces 25*a*, as compared with the remaining portions of the body.

It is understood that the outer layers 23 can be dispensed with, so that the foam material body is composed exclusively from the core 25.

Figure 3:
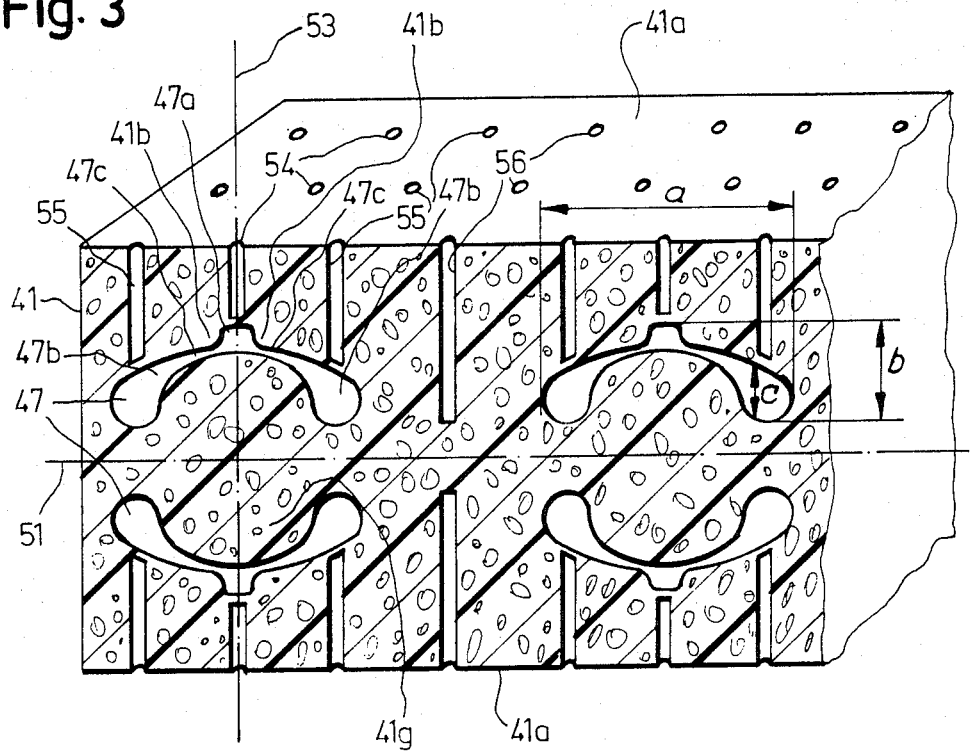
FIG. 3 is a sectioned perspective view of a mattress in accordance with another embodiment of the invention.

FIG. 3 shows another embodiment of the foam material body which is identified in toto by reference numeral 41 and is formed as a one-piece body. The foam material body 41 is limited from above and from below by at least in general supporting surfaces 41*a*. Both supporting surfaces extend in the undeformed foam material body 41 flat and parallel to one another. The foam material body is symmetrical to a central plane 51 which extends in the middle between its supporting surfaces 41*a*. Channels 47 are provided at the lower side and at the upper side of the central plane 51 and are arranged in pairs symmetrical to one another. The channels 47 extend parallel to the width of the mattress, that is normal to the general lying direction of a person who uses the mattress. They extend over the entire width of the mattress so that they are open at both longitudinal side surfaces of the foam material body.

The channels 47 in their cross section, that is in the section shown in FIG. 3, is surrounded at all their sides by the foam material of the foam material body 41 and has a shape which is similar to the shape of the channels 27 of FIG. 2. Each channel 47 has namely at its side remote from the central plane 51 an initial or middle channel portion 47*a*, and two enlarged portions at its side facing toward the central plane 41, the enlarged portions being formed by two deeper channel portions 47*b* extending away from one another and from the middle channel portion 47*a*. The deeper channel portions 47*b* are bent away from the middle channel portion 47*a* toward the central plane 51. Each deeper channel portion 47*b* is provided with a narrow channel portion 47*c* which is arranged between the middle channel portion 47*a* and the respective deeper channel portion 47*b*. Finally, each channel 47 in the undeformed foam material body is symmetrical relative to a plane of symmetry 53 which extends in the direction of elongation of the channel normal to the central plane 51 through the middle of each of the middle channel portions 47*a*.

Each channel 47 has in its cross section three portions extending from one connecting point. Namely, each channel 47 has a short initial or middle channel portion 41*b* extending from the connecting point at a side opposite to the central plane 51, and two deeper channel portions 47*b* both extending from the connecting point at different sides from the plane of symmetry 53.

The cross section of each channel 47 has one maximum dimension which is measured in direction parallel to the generally flat supporting surfaces 41*a*, and another maximum dimension which is measured in direction normal to the supporting surfaces 41*a* and identified by reference character b. Finally, a maximum distance between the limiting faces of each deeper channel portion 47*b*, as measured in direction normal to the supporting surfaces 41*a*, is identified with reference c. The maximum dimension a is greater than the maximum dimension b, namely at least twice as great as the latter. Correspondingly, the maximum dimension a is greater than the distance c and particularly is twice as great as the latter. The dimension a amounts to approximately 3–6 times the distance c. The distance c is not only the greatest distance between the limiting faces of each of the deeper channel portions, as measured normal to the supporting surfaces, but also the great distance between the limiting surfaces of the whole channel 47.

The foam material body is further provided with openings, 54, 55, 56 which are, for example, round and extend normal to the flat central plane 51. These openings open at the supporting surfaces 41*a*. The openings 54 in their horizontal projection, or in other words in a perpendicular projection on the central plane 51, are distributed along the middle lines of the middle channel portions 47. The openings 55 are also distributed in rows parallel to the channels 47 and are located in the horizontal projection in the region of the deeper channel portions 47*b*. The openings 56 are finally arranged between the neighboring channels 47. Between the ends of the openings 54, 55 and the channels a foam material of the foam material body remains. Thus, the openings 54, 55, 56 are formed as blind holes.

Between each channel 47 and the respective supporting surface 41, a section of the foam material body is provided which is subdivided by the middle channel portion 47*a* partially into two more or less lip-shaped sections 41*b*. Each two channels 47 located at opposite sides of the central plane 51 together bound a web 41*g*.

Each channel 47 is surrounded over its entire length at all sides of its cross section, for example around the same, by continuous sections of the foam material body 41.

Figure 4:
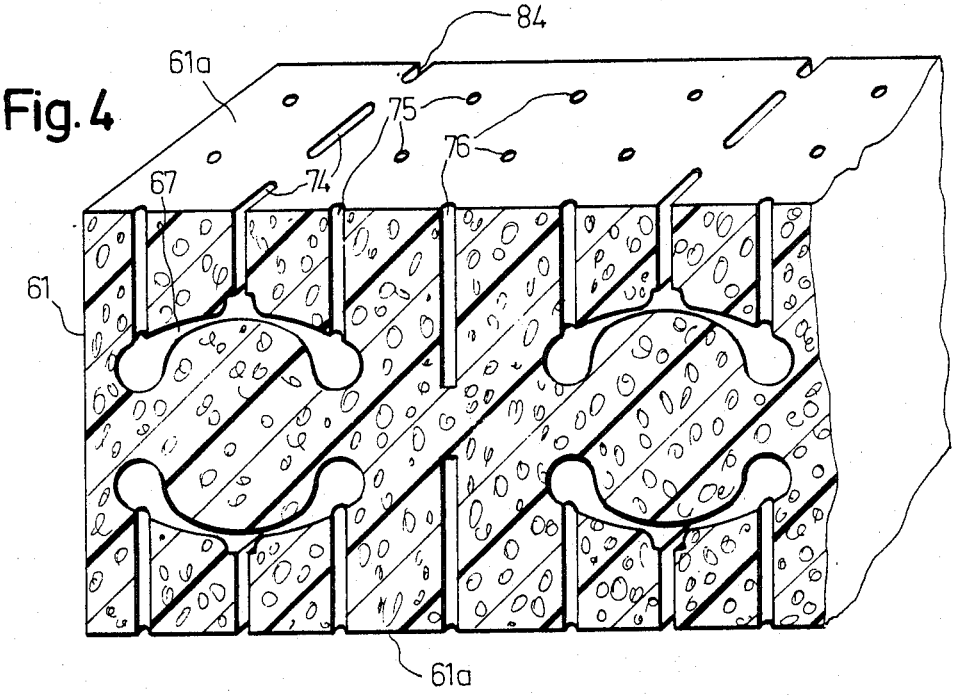
FIG. 4 is a sectioned perspective view of a mattress in accordance with a further embodiment of the present invention.

FIG. 4 shows a foam material body in accordance with a further embodiment of the invention, which is identified with reference numeral 61. This foam material body is formed similarly to the foam material body 41 of FIG. 3 and has two supporting surfaces 61*a* and channels 67 which correspond to the channels 47. The foam material body 61 differs from the foam material body 41 in that, instead of the round openings 54, a slot-shaped openings 74 extending in direction of elongation of the channels 67 are provided. At both ends of each row of openings 74 parallel to the channels 67, slots or cut-outs 84 extend from the lateral surfaces of the foam material body and are formed similarly to the openings 74. Furthermore, round openings 75 and 76 can also be provided and arranged similarly to the openings 55 and 56 of the foam material body 41. The openings 74, 75 and the slots 84 open into the channels 67 and connect the latter also in the region of the supporting surfaces 61 with an outer space surrounding the foam material body 61. In those longitudinal portions of the channels 67 in which no openings open, the channels are surrounded in their cross section at all sides by continuous portions of the foam material.

In connection with this, it should be mentioned that naturally in the foam material body 41 the openings 54 and/or 55 can be extended so that they open in the channels 47. To the contrary, in the foam material body 61 the depth of the openings 74 and 75, as well as the slots 84 can be reduced, so that these openings and slots no longer extend to the channels. Further, the openings which open at the supporting surfaces can be dispensed with, so that similarly to the foam material body 21 shown in FIG. 2, layers are provided between the inner core of the foam material body having the channels and its outer surfaces, the layers having no openings with the exception of the pores. In addition, in the embodiment shown in FIGS. 2, 3 and 4, and all mentioned options, a foam material layer can be provided in the region of the central planes 31, 51. These foam material layers can extend over the entire foam material body and can be compact and opening- and channel-free, with the exception of the pores. It is however eventually possible to form the above mentioned openings, for example the openings 56 or 76, as throughgoing openings.

The foam material bodies 41 and 61 can be constituted of, for example, polyurethane, polyester, or advantageously of latex foam. In the latter case, both original (natural) latex and also synthetic latex (a latex-like synthetic plastic material) can be used.

When a mattress is used with the foam material body 41 or 61, the webs 41*g* of foam material body 41 and the respective webs of the foam material body 61 serve as hinge pins, similarly to the webs 25*c* of the foam material body 21. The openings 54, 55, 56 of the foam material body 41 or the openings 74, 75, 76 and the slots 84 of the foam material body 61 increase the deformability of the outer layers of the foam material body, located between the supporting surfaces 41*a* and 61*a* and the channels 47 or 67. The lip-shaped sections 41*b* can slide similarly on the hinge pin-like webs 41*g*, which is the case for the lips are separated in the region of the planes of symmetry 53 completely from one another. The analogy is true for the foam material body 61. Finally, the openings extending into the supporting surfaces in the foam material body 41, 61 provide an additional ventilation.

For the manufacture of the foam material body 41 and 61, a liquid serving for formation of the foam material can be supplied in molds and brought in the latter to foaming. Such molds can include a lower part with a bottom and a plurality of walls, and an upper part which is plate-shaped to the main axis and is separable from the lower part. The lower can be provided with shaped rods during foaming steps for formation of the channels 47 or 67, the rods being removed after the foaming step. Furthermore the lower part and the upper part can be provided with upwardly and downwardly extending bars to form during the foaming step the openings 54, 55, 56 or the openings 74, 75, 76 and slots 84.

It is to be understood that in the foam material bodies 41 and 61, in addition to the channels 47 or 67 further channels can be provided which correspond to the channels 32 of the foam material body 21. The foam material body 21, 41, 61 are suitable particularly for the formation of mattresses of furniture for lying. They also can be used as pads of furniture for sitting.

It will be understood that each of the elements described above, or two or more together, may also find a useful application in other types of constructions differing from the types described above.

While the invention has been illustrated and described as embodied in a foam material body for a pad, particularly a mattress, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A foam material body for a pad, particularly a mattress, comprising a body part having in a position lying on a horizontal surface, a longitudinal inner plane and two supporting surfaces located at both sides of the latter, said body part having a plurality of channels located at both sides of said longitudinal inner plane and extending parallel to one another, each of said channels having a transverse plane of symmetry extending normal to said longitudinal inner plane of said body part, and each of said channels having a middle channel portion arranged at said plane of symmetry of the same channel, two deep channel portions located at opposite sides of said transverse plane of symmetry of the same channel and each including an end distant from said middle channel portion and a constriction between said end and said middle channel portion of the same channel, each of said deep channel portions of each of said channels being elongated and having a depth measured from the respective supporting surface and increasing in a direction away from said transverse plane of symmetry, each of said deep channel portions of each of said channels having a side facing toward said longitudinal inner plane and being limited at said side by a body part portion which forms a limiting face, said limiting face of each of said deep channel portions of each of said channels being curved in a direction away from said transverse plane of symmetry at least partially toward said longitudinal inner plane.

2. A foam material body as defined in claim 1, wherein each of said channels has a first cross section measured in direction parallel to said supporting surfaces and a second maximum cross section measured in direction normal to said supporting surfaces, said first cross section having a maximum dimension which is at least two times greater than the maximum dimension of said second cross section.

3. A foam material body as defined in claim 1, wherein each of said channels has a length extending parallel to said longitudinal inner plane and normal to said transverse plane of symmetry, each of said channels being completely surrounded in cross-section at all their sides by a material of said body part over at least a portion of the length of the respective channel.

4. A foam material body as defined in claim 3, wherein said body part includes a core member which contains said channels, and two outer layers adjoing said core member at its sides facing away of said longitudinal inner plane said core member being composed of a foam material having a predetermined softness, and said layers being composed of a foam material which is softer than the foam material of said core member.

5. A foam material body as defined in claim 3, wherein said body part is formed as a one-piece member so that each of said channels is surrounded cross-section at all its sides by continuous portions of a material of said one-piece member over at least a part of the length of the respective channel.

6. A foam material body as defined in claim 1, wherein said channels are arranged in pairs so that two channels of each pair are located at opposite sides of said longitudinal inner plane and symmetrical to one another, each of said deep portion of each of said channels bounding at the side of the respective supporting surface a lip-like section of said body part, and two channels of each pair bounding therebetween in said body part a web-like section arranged so that said lip-like sections at least during loading can support on said web-like sections.

7. A foam material body as defined in claim 1, wherein said channels are arranged in pairs so that two channels of each pair are located at opposite sides of said longitudinal inner plane and symmetrical to one another, each of said channels having a cross section measured in direction parallel to said supporting surfaces and having one maximum dimension, and each of said deep portions having a cross section measured in direction normal to said supporting surfaces and having another maximum dimension, said one maximum dimension of the cross section of each of said channels being greater than said other maximum dimension of the cross section of each of said deep channel portions of the same channel.

8. A foam material body as defined in claim 7, wherein said one maximum dimension of the cross section of each of said channels is at least two times greater than said other maximum dimension of the cross section of each of said deep portions of the same channel.

9. A foam material body as defined in claim 7, wherein each of said channels has a cross section measured in direction normal to said supporting surfaces and having a third maximum dimension, said one maximum dimension being at least two times greater than said third maximum dimension.

10. A foam material body as defined in claim 7, wherein each of said channels has a length extending parallel to said longitudinal inner plane and normal to said transverse plane of symmetry, each of said channels being surrounded at all their sides by a material of said body part over at least a portion of the length of the respective channel.

11. A foam material body as defined in claim 10, wherein said body part includes a core member which contains said channels, and two outer layers adjoining said core member at its sides facing away from said longitudinal inner plane said core member being composed of a foam material having a predetermined softness, and said layers being composed of a foam material which is softer than the foam material of said core member.

12. A foam material body as defined in claim 10, wherein said body part is formed as a one-piece member so that each of said channels is surrounded at all its sides by continuous portions of a material of said one-piece member over at least a part of the length of the respective channel.

13. A foam material body as defined in claim 7, wherein each of said deep channel portions of each of said channels has a depth measured from the respective supporting surface and increasing in a direction away from said transverse plane of symmetry.

14. A foam material body as defined in claim 7, wherein each of said deep channel portions of each of said channels has a side facing toward said longitudinal plane and is limited at said side by a body part portion which forms a limiting face, said limiting face of each of said deep channel portions of each of said channels being curved in a direction away from said transverse plane of symmetry at least partially toward said longitudinal plane of symmetry.

15. A foam material body as defined in claim 7, wherein each of said deep portions of each of said channels bound at the side of the respective supporting surface a lip-like section of said body part, and two channels of each pair bounding therebetween in said body part a web-like section arranged so that said lip-like sections at least during loading can support on said web-like section.

16. A foam material body as defined in claim 1, wherein said channels are arranged in pairs so that two channels of each pair are located at opposite sides of said longitudinal inner plane symmetrically to one another and form therebetween in said body part of a web-like section, each of said deep channel portions of each of said channels having a depth measured from the respective supporting surface and increasing in direction away from said middle channel portion, so that each of said web-like sections formed between two channels of each pair extends toward said middle channel portion of the respective channel.

17. A foam material body as defined in claim 1, wherein said channels are surrounded in cross section by material of said body part over all their length.

18. A foam material body as defined in claim 1, wherein said body part has a plurality of holes penetrating from at least one of said supporting surfaces substantially normal to the latter.

19. A foam material body as defined in claim 18, wherein said body part has a further plurality of holes penetrating from the other of said supporting surfaces substantially normal to the latter.

20. A foam material body as defined in claim 1, wherein said restriction has a minimum thickness equal to at most 2 mm.

* * * * *